US005282630A

United States Patent [19]

Dupuis, Jr.

[11] Patent Number: 5,282,630

[45] Date of Patent: Feb. 1, 1994

[54] CAR RACE GAME APPARATUS

[76] Inventor: Amedee J. Dupuis, Jr., 2 Gale Village Rd., Newton, N.H. 03858

[21] Appl. No.: 991,851

[22] Filed: Dec. 15, 1992

[51] Int. Cl.[5] ..... A63F 3/00

[52] U.S. Cl. ..... 273/252

[58] Field of Search ..... 273/242, 243, 252, 254, 273/248, 249, 251

[56] References Cited

U.S. PATENT DOCUMENTS

| | | | |
|---|---|---|---|
| 1,505,071 | 8/1924 | Fraser | 273/252 |
| 1,524,740 | 2/1925 | Lorenz | 273/251 |
| 2,128,608 | 8/1938 | Goertemiller | 273/251 |
| 2,470,632 | 5/1949 | McLeod | 273/252 |
| 4,932,666 | 6/1990 | Corle | 273/251 X |
| 4,953,871 | 9/1990 | Antwi | 273/252 |
| 5,002,283 | 3/1991 | Langham et al. | 273/252 |
| 5,108,111 | 4/1992 | Bilodeau | 273/252 X |

FOREIGN PATENT DOCUMENTS

| | | | |
|---|---|---|---|
| 922772 | 4/1963 | United Kingdom | 273/251 |
| 2246958 | 2/1992 | United Kingdom | 273/251 |

*Primary Examiner*—William Stoll

*Attorney, Agent, or Firm*—Frederick R. Cantor

[57] ABSTRACT

A car race game apparatus, which includes a playing board, marked to provide a system of interconnected branch roads. The road system is sub-divided into multiple contiguous spaces, arranged between a START space and a FINISH space, such that each game player can move an individual token from space to space, in an effort to reach the FINISH space, before the other players. Selected spaces are marked, so that when a token lands on such spaces, the token has to be returned to a designated space near the START space. Also, a pack of direction cards is provided for directing a player to return his/her token back to a designated space, when the player's token passes through specially marked STOP spaces, located in immediate proximity to the branch road intersection points. The game is designed to introduce penalties into the play, so that even when a player's token is considerably behind the leading player's token, there is always a possibility that the leading player will be penalized, thereby enabling any of the other players to still win the game.

3 Claims, 1 Drawing Sheet

CAR RACE GAME APPARATUS

BACKGROUND OF THE PRESENT INVENTION

The present invention, relates to board games.

The present invention, more particularly, relates to a car race game, wherein simulated car tokens are moved from space to space, along a road system, marked on a flat playing board, in accordance with the roll of the dice, or the spin of a spinner means. The player whose token is the first to reach a FINISH space, located at the end of a road system, is the winner of the game.

Various race games have been devised. U.S. Pat. No. 2,577,961, issued to F.R. Graves on Dec. 11, 1951, discloses a car race game that includes a game board, marked to define an annular endless track, having differently colored spaces, extending between a starting point, and a finishing point. A spinner disk, having a series of similarly colored sections, is provided for enabling the players to move simulated car tokens to different spaces on the endless track, in accordance with the positions of a rotary pointer, carried on the spinner disk.

U.S. Pat. No. 4,550,917, issued to M. J. Ferris, et al. on Nov. 5, 1985, shows a car racing game, wherein the game board has four laterally shiftable track sections, that may be manually moved, in order to block the advance of the opponent's car token along an endless two lane track system. The player's moves are determined by sequentially exposing specially marked cards, provided as part of the game apparatus.

U.S. Pat. No. 4,624,463, issued to K. W. Glennon on Nov. 25, 1986, discloses a car race game, that includes a game board, marked to form an annular track, having spaces containing notes, questions, or instructions, relating to the Indianapolis Memorial Day Race. Each player's token is advanced along the track, in accordance with the roll of dice, and/or, the answers to questions, appearing in selected ones of the track spaces, and/or, penalties or bonus points, appearing on cards drawn as a result of landing on specific track spaces.

U.S. Pat. No. 5,048,841, granted to R. A. Manney et al. on Sep. 17, 1991, contemplates a race game in which tokens are moved around a simulated race track, in accordance with the values of standard playing cards placed on the game board by the individual game players. Replacement cards are drawn from a stack of cards, to replenish cards placed on the board. Each player's token is, normally, confined to movement in one of the four lanes in the track, as determined by the suit of cards placed on the board by the player. Certain cards in the deck are designated as wild cards, for enabling a player to switch his/her token to a different lane in order to utilize more cards, and/or, to displace another player's token from the track.

U.S. Pat. No. 5,092,605, issued to C. L. Hoffman on Mar. 3, 1992, discloses a car race game in which the players' tokens are advanced along separate lanes in an annular track, in accordance with the roll of the dice. The players periodically predict the order of the finish of the various tokens. The game winner is the player who most accurately predicts the finishing order of the tokens.

U.S. Pat. No. 5,108,111, issued to E. Bilodeau on Apr. 28, 1992, discloses a maze board game, in which a game board is marked to provide a number of intersecting pathways between a START space and an END space. Directional arrows are provided on selected ones of the pathway spaces, such that when a player's token lands on one of the directional spaces, the respective token is required to reverse direction on the player's next turn, thus potentially delaying progress towards reaching the end space.

U.S. Pat. No. 5,114,151, issued to D. Bergerstock on May 19, 1992, shows a race game in which an oval game board is marked to provide an annular track, having three separate lanes. The spaces in each lane are marked with two of the six numbers that can appear on two thrown dice, e.g. one and four, or two and five. The dice are thrown to establish the tokens that can be advanced longitudinally along the individual lanes, or diagonally from one lane to another lane.

SUMMARY OF THE PRESENT INVENTION

An object of the present invention, is to provide a board game.

A further object of the present invention, is to provide a car race game, wherein simulated car tokens are moved from space to space, along a road system, marked on a flat playing board, in accordance with the roll of the dice, or the spin of a spinner means. The player whose token is the first to reach a FINISH space, located at the end of a road system, is the winner of the game.

Yet another object of the present invention, is to provide a car race game, wherein a game board is marked to provide a simulated road system, having a multiplicity of interconnected branch roads, extending between a START space and a FINISH space, whereby any player's token can be moved selectively along different branches, in order to reach the FINISH space. The number of spaces that a given token is to be moved during one player's turn is determined by a random number selection means, e.g., one or two dice, or a manually operable spinner means, or by numbers appearing on a card, turned up from a deck of cards.

The game apparatus includes a pack of direction cards, that may be individually exposed, only when a player's token is advanced through specially marked STOP spaces, located in immediate proximity to the branch road intersection points on the game board. Some of the direction cards contain indicia thereon, directing the player receiving the card to move his/her token to a designated space on the road system, e.g. a POLICE STATION space, or a BODY SHOP space. The designated spaces are located relatively close to the START space, such that the movement of a token to one of the designated spaces is away from the FINISH space, thereby making it more difficult for the token to reach the FINISH space.

Some of the direction cards have indicia thereon, directing the player receiving the card, to return his/her token to the road intersection point where the player's token passed through the STOP space. The player must then redirect the token along the branch road (instead of the original road). This feature changes the course of the token, and thus affects the degree of difficulty of reaching the FINISH space. The winner of the game is the player whose token first reaches the FINISH space.

Some of the spaces on the game board have special markings that require a player landing on the space to move the token to another location, or otherwise suffer some penalty. For example, if a player's token lands on a space marked "Go to the Movies", then the token must immediately be relocated on the MOVIES space. If a player's token should land on a space marked "Flat Tire" then, as a penalty, the player is forced to miss his/her next turn. Other marked spaces on the game board require specific relocations of the token, or otherwise necessitate some action on the player's part that can affect the game outcome.

In summary, and in accordance with the above discussion, the foregoing objectives are achieved in the following embodiments.

1. A car race game apparatus, comprising a playing board, having a road system marked thereon, for simulated car tokens, that can be moved therealong; said road system, comprising a multiplicity of contiguous spaces that include a START space, a FINISH space, and a series of STOP spaces, located at discrete points along the road system; said road system, being comprised of a series of interconnected branches, extending from the START space to the FINISH space, whereby a token can be moved selectively along different branches, in order to reach the FINISH space; a random number selection means, operated by each player, to determine the number of spaces that the player's token is to be advanced during each player's turn; and a pack of direction cards, said direction cards, being individually drawable from the pack by a player, only when that player's token is advanced through a STOP space; some of said direction cards, having indicia thereon, directing the player to move his/her token to designated spaces on the road system; and some of said direction cards, having indicia thereon, directing the player to turn the respective token onto a different branch of the road system.

2. The car race game apparatus, as described in paragraph 1, wherein one of the spaces on the road system is a POLICE STATION space; some of said direction cards having indicia thereon, directing said player to move his/her token to the POLICE STATION space; said POLICE STATION space being located between the START space and the first STOP space, such that a card-directed move of the token to the POLICE STATION space, is necessarily a move back, toward the START space.

3. The car race game apparatus, as described in paragraph 2, wherein one of the spaces on the road system is a BODY SHOP space; some of said direction cards, having indicia thereon, directing the player to move his/her token to said BODY SHOP space; and said BODY SHOP space, being located between said POLICE STATION space, and the first STOP space, such that a card-directed move of the token to the BODY SHOP space, is necessarily a move back, toward the START space.

4. The car race game apparatus, as described in paragraph 3, wherein selected spaces on the road system are marked to require that a token landing thereon must be relocated to the POLICE STATION space or the BODY SHOP space.

5. The car race game apparatus, as described in paragraph 4, wherein said selected spaces are located between the BODY SHOP space and the FINISH space, such that a directed move of a token to the POLICE STATION space, or the BODY SHOP, space is necessarily a move back toward the START space.

6. The car race game apparatus, as described in paragraph 1, wherein there are at least ten (10) STOP spaces, said STOP spaces being located in immediate proximity to said branch intersection points.

7. The car race game apparatus, as described in paragraph 1, wherein one of the spaces of the road system is a DRAGWAY space, located beyond the last STOP space; and a spinner means, operable by two players, when said two tokens occupy a single space of the road system; and the game rules being such that when two tokens occupy a single space, said two tokens can be moved to the DRAGWAY space, and said spinner means can be operated to determine which of the two players is to then have precedence for advancement of the respective tokens toward the FINISH space.

A BRIEF DESCRIPTION OF THE DRAWINGS

DESCRIPTION OF THE PREFERRED EMBODIMENTS OF THE PRESENT INVENTION

Figure 1:
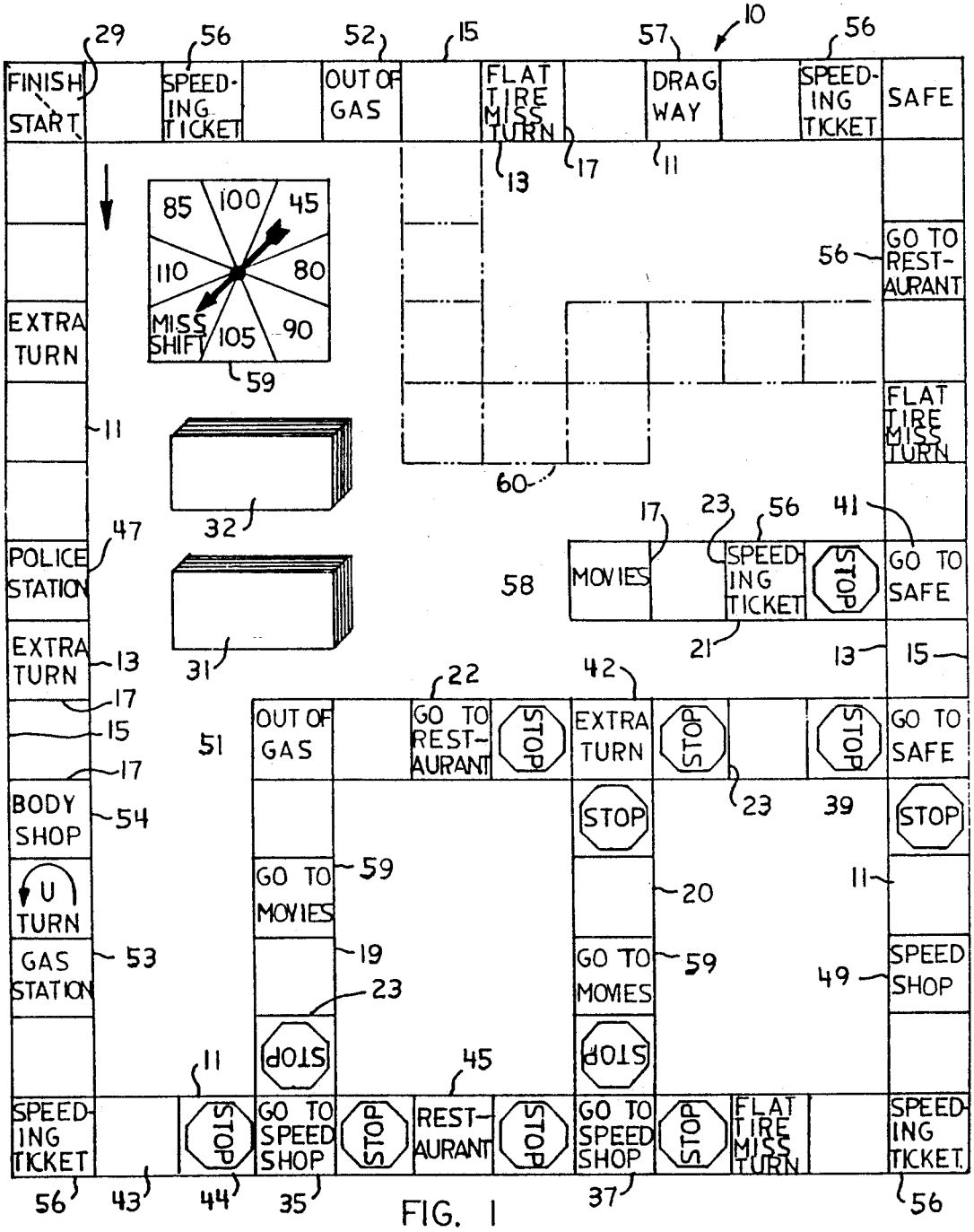
FIG. 1, is a plan view, of a game board, used in a car race game, embodying features of the present invention.

FIG. 1, is a plan view, of a game board, used in a car race game, embodying features of the present invention.

FIG. 1 shows, in plan view, a game board 10, that forms part of a car race game apparatus, embodying the present invention. The upper surface of the game board 10, is printed to define a road system, designated generally by numeral 11. The road system 11, comprises an annular main road, defined by a series of parallel lines, 13 and 15, extending around the periphery of game board 10. Transverse lines 17, interconnect the two parallel lines, 13 and 15, at regularly spaced points, to form a multiplicity of contiguous spaces.

In the illustrated game apparatus, there are fourteen (14) spaces formed along each side edge of the game board 10, and twelve (12) spaces formed along each of the top and bottom edges of the game board 10, as the game board 10, is viewed in FIG. 1. Additionally, there are other parallel lines printed on the game board 10, for defining branch roads, designated generally by numerals 19, 20, 21, and 22. Transverse lines 23, subdivide the branch roads into a number of contiguous spaces. In the illustrated game board 10, there are twenty (20) spaces, formed in the four (4) branch roads, 19, 20, 21, and 22. The perimeter road path, defined by lines 13 and 15, may be viewed as the main, or primary, branch in the road system. The connecting branches, 19, 20, 21, and 22, may be considered as the side streets, or secondary branches.

Figure 2:
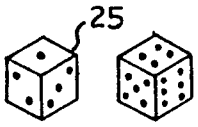
FIG. 2, is a perspective view, of a set of dice, that can be used with the FIG. 1 game board.

FIG. 2, is a perspective view, of a set of dice, that can be used with the FIG. 1 game board.

Figure 3:
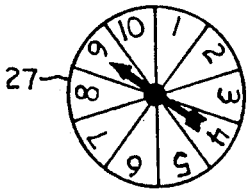
FIG. 3, is a plan view, of a spinner device, that is an alternative random number selection means, to the dice, shown in FIG. 2.

FIG. 3, is a plan view, of a spinner device, that is an alternative random number selection means, to the dice, shown in FIG. 2.

Each defined space in the various branches of the road system, is large enough to accommodate a miniature token, for movement from one space to another space, according to a random number, determined by chance. The random number selection means, can be a pair of dice 25, as shown in FIG. 2, or a spinner means 27, as shown in FIG. 3. When dice 25, are used, the number of spaces that a token can be moved, during each player's turn, will vary from two to twelve; if only one die is used, the number of spaces that a token can be moved during each turn will vary from one to six.

When the spinner means 27, is used, the number of spaces that a token can be moved, during any player's turn, will vary from one to ten. Each miniature token can be a simulated car, truck, or bus, having a length of about three-quarters of an inch. Each space in the road system 11, may be a square space, measuring about one inch on a side.

The road system 11, includes a space 29, that designates both a START zone and a FINISH zone, for the tokens. The tokens are normally moved from the START zone, in a counterclockwise direction along the annular main road, i.e, downwardly along the left edge of the game board, then rightwardly along the bottom edge of the game board, then upwardly along the right edge of the game board, and then leftwardly along the top edge of the game board, back to the FINISH zone. The winner of the game is the player whose token is the first to move, from the START zone, around the game board 10, to the FINISH zone.

Any number of people can play the game, e.g., from two people up to about six people. Each player will move his/her token along the defined road system from the START space, to the FINISH space.

Ordinarily the players start the game by operating the random selection means, i.e., the dice or spinner. The first person to play is the player having the highest random number. The players play sequentially in clockwise order around the table.

The game apparatus, includes a pack of direction cards 31, placed face down on the game board 10, so that printed directions on the cards are concealed from view. Each player is required to draw the uppermost one of the direction cards from the pack 31, whenever his/her token advances through one of the STOP spaces 44, except, if the token begins the advance from a STOP space. The illustrated game board 10, has twelve (12) STOP spaces, located in immediate proximity to branch intersection spaces, 35, 37, 39, 41 and 42.

Some of the direction cards, will have instructions thereon, requiring the player, picking up the direction card, to perform some activity, e.g., to change the position of his/her token, or to alter the path taken by the token. Typically, the pack may contain forty (40) direction cards, containing five (5) different messages. For example, five of the direction cards may be "Red Light" cards, containing the message, "Stopped by the Police; Go back to the Police Station." Five of the direction cards may be "Fender Bender" cards, containing the message, "Fender Bender; Go back to the Body Shop." Ten (10) of the direction cards may have the direction, "You must return to the last branch intersection and make a left turn (or a right turn)." Ten of the direction cards may read, "Congratulations, you made it, there is no traffic violation. Stay where you are."

The number of direction cards containing a particular message can vary, e.g., the pack could include ten direction cards containing the message "Stopped by the police; Go back to the Police Station." Messages on the direction cards, other than those listed above, are also contemplated. At the beginning of the game, the direction cards will, preferably, be shuffled, or rearranged, so that the participants do not know the nature of the message on the uppermost card in the pack at any one moment.

In the illustrated road system, a token must, in most cases, make a left turn, in order to move from the main perimeter road to a connecting branch. For example, if a token is forced to turn from the perimeter road onto branch road 19, at intersection 35, the turn must be in the leftward direction. However, when a token is approaching intersection 42, from branch road 20, or from the left portion of branch road 22, it is possible to make a right turn at that intersection. Similarly, when a token is on branch road 22, and approaching intersection 39, it is possible to make a right turn at that intersection. In some situations, when a player draws a card, from pack 31, that requires a left turn, or a right turn, the token may be so re-oriented so that it is moving back towards the START space, rather than toward the FINISH space. Direction cards 31, therefore, in many cases, act as an extreme penalty for the person picking up the card.

By way of illustrating the employment of the direction cards 31, we will assume that a player's token is located on space 43, and that the player either rolls dice 25, or rotates spinner means 27, to obtain the number "4". The player therefore advances his/her token four spaces to space 45. During this process, the token passes through STOP space 44, and intersection space 35, such that the player is required to immediately draw the uppermost direction card from the pack of direction cards 31, and perform any activity directed by the card, e.g., move the token back to the POLICE STATION space 47, or turn his/her token onto branch road 19.

If the player's token had initially been on STOP space 44, when the token was advanced through intersection 35, then the player would not have been required to draw a direction card from the pack of direction cards 31. The player is only required to draw a direction card from the pack 31, when his/her token is advanced through a STOP space, and the token is initially on a space that is either blank, or has some designation, other than STOP. The various STOP spaces are clustered around, or in immediate proximity to, the various branch intersection spaces, i.e., 35, 37, 39, 41 and 42. The STOP spaces, thus simulate real life STOP signs or STOP lights, located at actual street intersections. The process of moving a token through a STOP space at an intersection, is analogous to running a car through a STOP sign, or a red light, in real life. The direction cards, are designed, for the most part, to penalize the player going through a STOP space. If the player's token lands on a STOP space, rather than going through a STOP space, the player is not required to draw a direction card from the pack 31, as the player is considered to be obeying the traffic laws. Also, a STOP space located after the intersection has no effect on the play, since it is not intended to halt traffic that has passed through the intersection. Only when the token advances through a STOP space at the entrance to an intersection, is there a requirement for drawing a direction card from the pack of direction cards 31.

The spaces on the game board 10, contain two spaces marked "Go To Speed Shop." If a player's token lands on either of these spaces, the token is immediately moved to the SPEED SHOP space, identified by numeral 49, in FIG. 1.

The game board 10, has two (2) spaces, i.e., 51 and 52, marked OUT OF GAS. If a player's token lands on either of these particular spaces, the token must immediately be moved back to the GAS STATION, referenced by numeral 53, in FIG. 1.

The game board 10, also has five (5) spaces 56, marked SPEEDING TICKET. If a player's token lands on any one of these spaces, the player is required to move his/her token back to the POLICE STATION space 47.

The game board 10, has two spaces marked GO TO RESTAURANT. If a player's token lands on one of these spaces, the token must be immediately relocated to the RESTAURANT space 45. Additionally, the player must miss his/her next turn.

There are other spaces on the game board, marked GO TO THE MOVIES, or GO TO SAFE. When a player's token lands on any of these spaces, the token is immediately moved to the appropriate designated space. The rules can also provide that when a player's token is moved to the MOVIES space 58, the player will miss his/her next turn.

There are three spaces on the game board 10, marked EXTRA TURN. If a player's token lands on any one of these spaces, the player is allowed to draw an EXTRA TURN card from a second pack of cards 32, located at a central point on the game board 10. Each of the cards in pack 32, has the same message, i.e., that the player drawing the card is entitled to an extra turn. The card can be used to avoid missing the player's next turn, e.g., should the player's token land on a GO TO RESTAURANT space, or a GO TO MOVIES space. The EXTRA TURN card can also be use when the player's token lands on any one of three FLAT TIRE spaces. The rules can provide for additional instances where a player will miss a turn; e.g., when the player's token lands on RESTAURANT space 45. The EXTRA TURN card can be used as a countermove to avoid missing a turn.

There is a single space on the game board 10, marked U-TURN. This space can be used to advantage if a player's token is moving in a clockwise (up) direction when the token reaches the U-TURN space. In such a case, the player can reverse the direction of token travel so as to move in the counterclockwise direction, i.e., toward the FINISH space.

It will be noted that the spaces marked POLICE STATION and BODY SHOP are located between the START space 29, and the first STOP space 44. This means that when the player's token passes through any of the STOP spaces, and the player draws the appropriate direction card from pack 31, then any relocation of the token to the POLICE STATION space, or the BODY SHOP space is, necessarily, a move back toward the START zone, and away from the FINISH zone. This feature tends to equalize the game, in that a player in the lead at any given moment, can have his/her token relocated further away from the FINISH zone. The POLICE STATION space 47, and the BODY SHOP space 54, may be considered PENALTY spaces, since a card-ordered move to either of these spaces is necessarily a backward move, away from the FINISH space.

In similar fashion, the RESTAURANT space 60, and the GAS STATION space 53, are located relatively close to the START zone. A player landing his/her token on any of the GO TO RESTAURANT spaces, or the OUT OF GAS spaces will, necessarily have to move the token in a reverse direction, i.e., away from the FINISH space.

The game is designed so that each of the players has a reasonably good chance of winning the game, even when the player is quite far behind the player that is momentarily in the lead.

As an optional feature, the game can also include a mechanism whereby one player can challenge another player to a grudge race, with the winner of the challenge advancing along the game board 10, at the expense of the other players. Under the game rules, whenever one player's token lands on a space already occupied by another player's token, the condition for a challenge is established. Under the challenge rule, the challenged player is the person first occupying the common space, while the second player to land on the space is the challenger. The challenged player can decline the challenge if he/she so decides. If the challenge is accepted, the tokens of the two players are advanced to the DRAGWAY space, referenced by numeral 57, in the drawings. The two players then individually operate a spinner mechanism 59, incorporated on the game board 10. The spinner mechanism 59 dial, is marked to indicate different road speeds, e.g., ninety miles per hour, or one hundred miles per hour. The winner of the challenge grudge race is the person who operates the spinner pointer to the higher speed on the spinner dial. However, if the player lands the spinner on the MISS SHIFT area, he /she is the loser. The winning player is permitted to immediately take another turn, with the other players following in clockwise order around the table.

The rules of the grudge race challenge, may provide that the two players participating in the challenge, continue play from the DRAGWAY space 57. Alternately, the rules may provide that the two participating players, resume play from the space on which the tokens were located, at the time of the challenge.

By way of summarizing the features of the game, the object of the game is for each player to advance his/her token from the START space, around the game board 10, and back to the FINISH space located at the upper left hand corner of the game board. The winner of the game is the player first reaching the FINISH space.

Each token can take various routes, in order to reach the FINISH space. The primary route will be along the perimeter road system 11. However, any token can also advance toward the FINISH space by movement along the secondary branch roads 19, 20, 21, and 22. Branch road 21 is a "dead end" street that can only be reached by landing a token on the GO TO THE MOVIES space 59.

Direction cards 31, come into play when a player's token passes through one of the STOP spaces, in proximity to the branch intersections, i.e., 35, 37, 39, 41, and 42. In such a situation, a player drawing a card from the pack of direction cards 31, is required to perform the activity set forth on the card, e.g., relocate his/her token at the POLICE STATION space 47, or turn the token onto a different street, or branch, at the branch intersection where the STOP space was passed. If a player's token lands on a STOP space, rather than going through the STOP space, the player does not have to draw a card from the pack of direction cards 31.

If a player draws a direction card 31, that requires a left turn, or a right turn, the player must return the token to the intersection where the passed STOP space was located. The token must then be advanced in the appropriate direction, on a new path. If it is not possible to make a turn in the direction required by the card, then the token is moved along its original path.

Some of the spaces on the game board 10, carry special penalties or rewards. For example, if a token lands on any of the six (6) SPEEDING TICKET spaces 56, the player is required to return his/her token to the POLICE STATION space 47. Similarly, if a token lands on either of the two OUT OF GAS spaces, the token must immediately be moved back to the GAS STATION space 53.

The inclusion of direction cards 31, and the specially designated spaces 51, 52, and 56, provide penalties that tend to equalize the game for the participants, so that even when one player is ahead of the other players at any one moment, there is always the possibility that the leading player will encounter a penalty situation, that will return that player to one of the designated spaces 47, 54, or 53, in near proximity to the START space, i.e., relatively remote from the FINISH space.

The grudge race challenge feature comes into the play when the tokens of any two players occupy a common space on the game board 10. If the challenged player accepts the challenge, the two tokens are moved to DRAGWAY space 57, and the two players operate the spinner mechanism 59, to determine the winner of the challenge. The winner is permitted to take the next turn, at the expense of the other players.

It is contemplated that the game board can be constructed to have a variety of different road systems 11, containing multiple intersecting branch roads. The road system 11, shown in FIG. 1, is merely illustrative of different road systems that could be devised. One possible additional branch road that could be incorporated into the illustrated road system 11, is indicated by the dashed line 60.

The present invention describes a car race board game. Features of the present invention are recited in the appended claims. The drawings contained herein necessarily depict structural features and embodiments of the game apparatus, useful in the practice of the present invention.

However, it will be appreciated by those skilled in the arts pertaining thereto, that the present invention can be practiced in various alternate forms and configurations. Further, the previous detailed descriptions of the preferred embodiments of the present invention, are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. A car race game apparatus, comprising:

a playing board having a road system marked thereon;

a plurality of simulated car tokens, movable along said road system;

said road system comprising a multiplicity of contiguous spaces;

said contiguous spaces including a START space, a FINISH space, a series of STOP spaces located at discrete points along the road system, and at least one PENALTY space;

said road system being comprised of a primary road, extending from the START space to the FINISH space, and a series of branch roads intersecting said primary road, to form alternate paths that a token can take, in order to move toward the FINISH space;

said primary roads and said branch roads having shared intersection spaces at the points where said roads intersect;

said STOP spaces being contiguous to said intersection spaces, so that each intersection space has at least one STOP space contiguous thereto;

at least one PENALTY space being located between the START space and the first STOP space;

a random number selection means, adapted to be operated by each player, in order to determine the number of spaces that a player's token is to be advanced during each player's turn;

a pack of direction cards, adapted to be individually drawn from the pack by a player only when the player's token is advanced through a STOP space, from a space that is not a STOP space;

some of said direction cards having indicia thereon directing the player to move the token to one of said PENALTY spaces on the road system;

some of said direction cards having indicia thereon directing the player to turn the respective token onto an intersecting road at the next intersection space; and at least one of said PENALTY spaces being located between the START space and the first STOP space, so that a card-directed move of a token to a PENALTY space is necessarily a move back toward the START space, and away from the FINISH space.

2. The card race game apparatus, as described in claim 1, wherein one of said PENALTY spaces is a POLICE STATION space, and another of said PENALTY spaces is a BODY SHOP space.

3. The car race game apparatus, as described in claim 2, wherein one of the spaces in the road system is a DRAGWAY space;

said DRAGWAY space being located between the last STOP space and the FINISH space;

a spinner means, adapted to be operated by two players when the token of said two players simultaneously occupy a single space in the road system;

said spinner means being operable by each of the two players to determine the winner of a DRAGWAY race; and the game rules being such that when the token of two players simultaneously occupy a single space, said tokens are moved to the DRAGWAY space, and said spinner means is operated to determine which of the two players is to have precedence for operating the random number selection means on continuation of the game.

* * * * *